US006863498B2

(12) United States Patent
Liang

(10) Patent No.: US 6,863,498 B2
(45) Date of Patent: Mar. 8, 2005

(54) BLADE SPREADING ASSEMBLY FOR QUICK CEILING FAN INSTALLATION

(75) Inventor: Hai Liang, Zhongshan (CN)

(73) Assignee: Hoo Cheung Group Ltd., Kowloon (HK)

( * ) Notice: Subject to any disclaimer, the term of this patent is extended or adjusted under 35 U.S.C. 154(b) by 197 days.

(21) Appl. No.: 10/358,791

(22) Filed: Feb. 5, 2003

(65) Prior Publication Data

US 2004/0151588 A1 Aug. 5, 2004

(51) Int. Cl.[7] ..... F04D 29/34

(52) U.S. Cl. ..... 416/142; 416/205; 416/210 R; 416/244 R; 416/248

(58) Field of Search ..... 416/142, 205, 416/210 R, 244 R, 248

(56) References Cited

U.S. PATENT DOCUMENTS 1,361,785 A * 12/1920 Tucker ..... 416/142
1,583,864 A * 5/1926 Tucker ..... 416/142
4,776,761 A * 10/1988 Diaz ..... 416/5
6,027,309 A 2/2000 Rawls et al.
6,213,716 B1 4/2001 Bucher et al.

* cited by examiner

*Primary Examiner*—Ninh H. Nguyen
(74) *Attorney, Agent, or Firm*—Frommer & Lawrence & Haug LLP; Ronald R. Santucci

(57) ABSTRACT

A blade spreading assembly for quick ceiling fan installation is disclosed. The blade spreading assembly comprises a fan rotor bracket attached to the fan rotor and operatively coupled to an arm which connects to fan blade. The assembly allows the attached fan blade to collapse for storage and shipment and spread for operation. Since the blades are pre-attached by the manufacturer, the user is only required to unpack the ceiling fan from the shipment box and hang the fan up at a desired location and have the fan blades spread out with a simple single push. The fan blades can likewise be collapsed for storage with relative ease.

11 Claims, 8 Drawing Sheets

BLADE SPREADING ASSEMBLY FOR QUICK CEILING FAN INSTALLATION

FIELD OF THE INVENTION

This invention relates to a blade spreading assembly for quick and easy installation of ceiling fans. The blade spreading assembly enables the ceiling fan manufacturer to pre-attach fan blades to the fan rotor in the factory plant. By employing the inventive mechanism of the blade spreading assembly, users are only required to unpack the ceiling fan with the blades pre-attached, hang the fan up and spread the fan blades out to the horizontal operating position and the whole installation can be completed with relative ease.

BACKGROUND OF THE INVENTION

Ceiling fans are very common household and commercial appliances. Conventional ceiling fans are difficult to install due to the installer having to perform a number of difficult manoeuvres. Installing a conventional ceiling fan usually means the installer standing on a stool or scaffold trying to work overhead with the mechanical and electrical attachments of the motor housing and rotor components of the fan. After the motor housing and rotor are properly positioned, the installer must then attach the fan blades to the fan rotor. This typically means trying to work from the underside of the fan and to fasten the blades and/or blade mounting arms to the motor or rotor by screws with precision. Depending on the number of blades, the same procedure has to be repeated a few times before installation is completed. Such traditional blade fastening method is highly unsatisfactory. It requires the installer great dexterity, patience, efforts and time in order to connect each and every blade to the fan rotor. In countries where labour costs are high, installing a ceiling fan can be very expensive.

It is therefore highly desirable to have the ceiling fan manufacturer pre-assemble the fan blades onto the fan rotor so that a user only needs to simply unpack the fan and hang it up in the ceiling. However, ceiling fans with pre-assembled fan blades take up a lot of space and makes packaging very difficult, if not impossible. The box containing a ceiling fan with its blades fully pre-assembled in a spread out horizontal position is bulky, awkward to handle and expensive to ship. This accounts for one of the main reasons why ceiling fans are still packaged in the conventional manner and leave the blade installation described above to the users.

In view of the foregoing shortcomings, it is advantageous to have a ceiling fan whereby the blades are factory pre-assembled but the fan blades are collapsible so that the fan can be packaged in such a way that it does not become bulky and awkward to transport. Attempts have been made to achieve this objective in the prior art. For example, U.S. Pat. No. 6,213,716 (issued to Bucheretal. on Apr. 10, 2001) teaches a folding fan and packaging materials for shipping such a fan. However, the Bucher et al. design does not provide a fan blade folding mechanism that is secure for the ceiling fan operation. Once unfolded, the blades rest on a horizontal plane position by the restriction of the hinge movement and have to rely on sheer gravity to pull and hold themselves in the horizontal position. When in operation, this creates wobbling and is unsafe to use. Accordingly, it is beneficial to develop a blade spreading assembly such that the blades can be pre-attached to the rotor and operate in a secure fashion and, at the same time, collapsible for easy installation by the user and allows for inexpensive shipping.

It is also advantageous to be able to spread the pre-attached blades or to dislodge the unfolded blades by a single simple step without having the need to use special tools.

SUMMARY OF THE INVENTION

The present invention provides a blade spreading assembly for quick installation of a ceiling fan which addresses the aforementioned shortcomings. The blade spreading assembly connects the fan rotor to the blades and allows the blades to collapse or spread out. In the spread out position, a mechanism is provided to hold the blades in secure, horizontal operating position. A simple lift and push action allows the user to collapse and fold the blades.

It is a principal object of the invention to provide a ceiling fan that is quick and easy to install by having the fan blades pre-attached in the factory and that all a user needs to do is to hang the fan and spread out the fan blades from the factory packed vertical position to their horizontal position for ready operation.

Accordingly, the present invention provides for a blade spreading assembly for quick ceiling fan installation. The assembly is comprised of a pivoting pin and a locking pin; a U-shaped fan rotor bracket with two upward side walls, such that each side wall is provided with an aperture and an arc-shaped slot for coupling with the pivoting pin and for guiding the upward and downward movement of the locking pin, respectively; said arc slot is provided with a recess notch and a locking notch at the top and at the bottom, respectively, for securing the pivoting pin and the locking pin in position; a blade connecting arm, whereby the connecting arm is substantially flat at one end for attaching to a fan blade and is U-shaped at the opposite end for operatively coupling with the pivoting pin and locking pin through an elongated aperture when the connecting arm is engaged with the fan rotor bracket; and a set of coil spring for urging the pivoting pin and the locking pin towards each other.

BRIEF DESCRIPTION OF THE DRAWINGS

Advantages and features of the invention will become more apparent with reference to the following description of the presently preferred embodiment thereof in connection with the accompanying drawings, wherein like references have been applied to like elements, in which:

FIG. 1(*b*) is a perspective view of a ceiling fan of the present invention showing three factory pre-attached fan blades in a horizontally spread out position.

FIG. 4(*b*) is a plan top view of a preferred embodiment of the blade spreading assembly attached to the right hand side of the fan rotor and shows part of one fan blade in a horizontally spread out position.

FIG. 5(*b*) is a plan side view of a preferred embodiment of the blade spreading assembly attached to the left hand side of the fan rotor and shows part of one fan blade in a upwardly collapsing position.

FIG. 8(*b*) is a plan side view of another embodiment of the blade spreading assembly attached to the left hand side of the fan rotor and shows part of one fan blade in a vertically collapsed position.

DETAILED DESCRIPTION OF THE PREFERRED EMBODIMENT

Figure 1A:
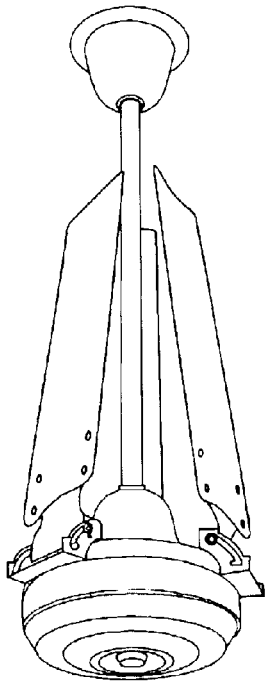
FIG. 1(*a*) is a perspective view of a ceiling fan of the present invention showing three factory pre-attached fan blades in a vertically collapsed position for packaging and shipping.
Figure 1B:
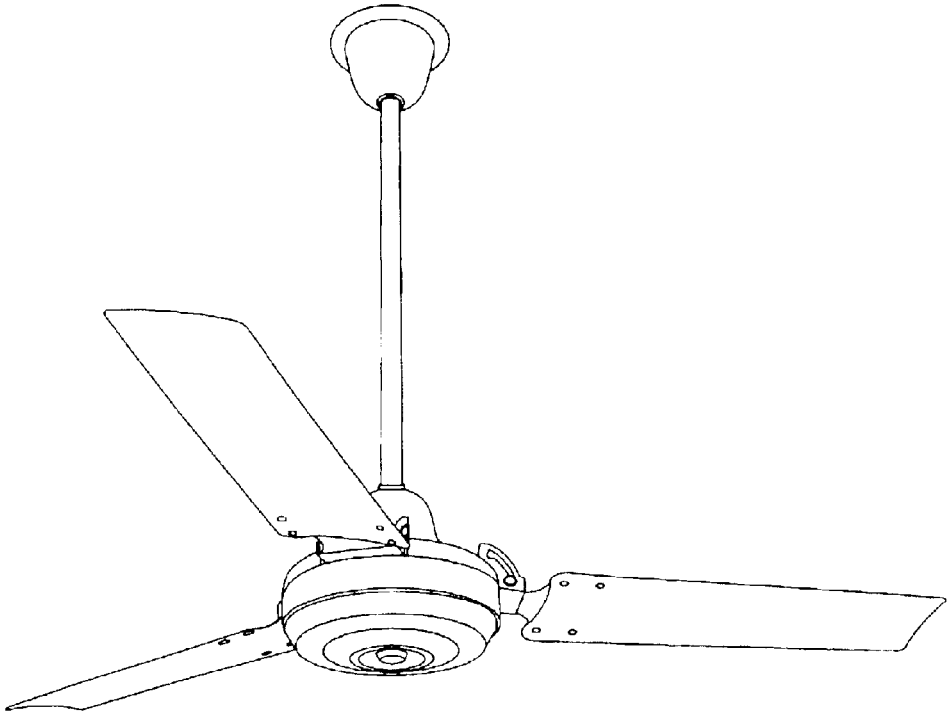

The blade spreading assembly for quick installation of ceiling fan of the present invention enables the manufacturer to pre-attach the fan blades at the factory and package and ship the compact ceiling fan with the blades vertically collapsed (see FIG. 1(*a*)). When a user unpacks a preferred embodiment of the ceiling fan of the present invention, all the user needs to do is to hang the fan up and pull the pre-attached fan blades downwards until it is secured in a locked position (see FIG. 1(*b*)). To return the blades to the collapsed position, the user only has to pull a quick release locking pin in the assembly and pushes the fan blade upwards until it stops in a recessed notch.

Figure 2:
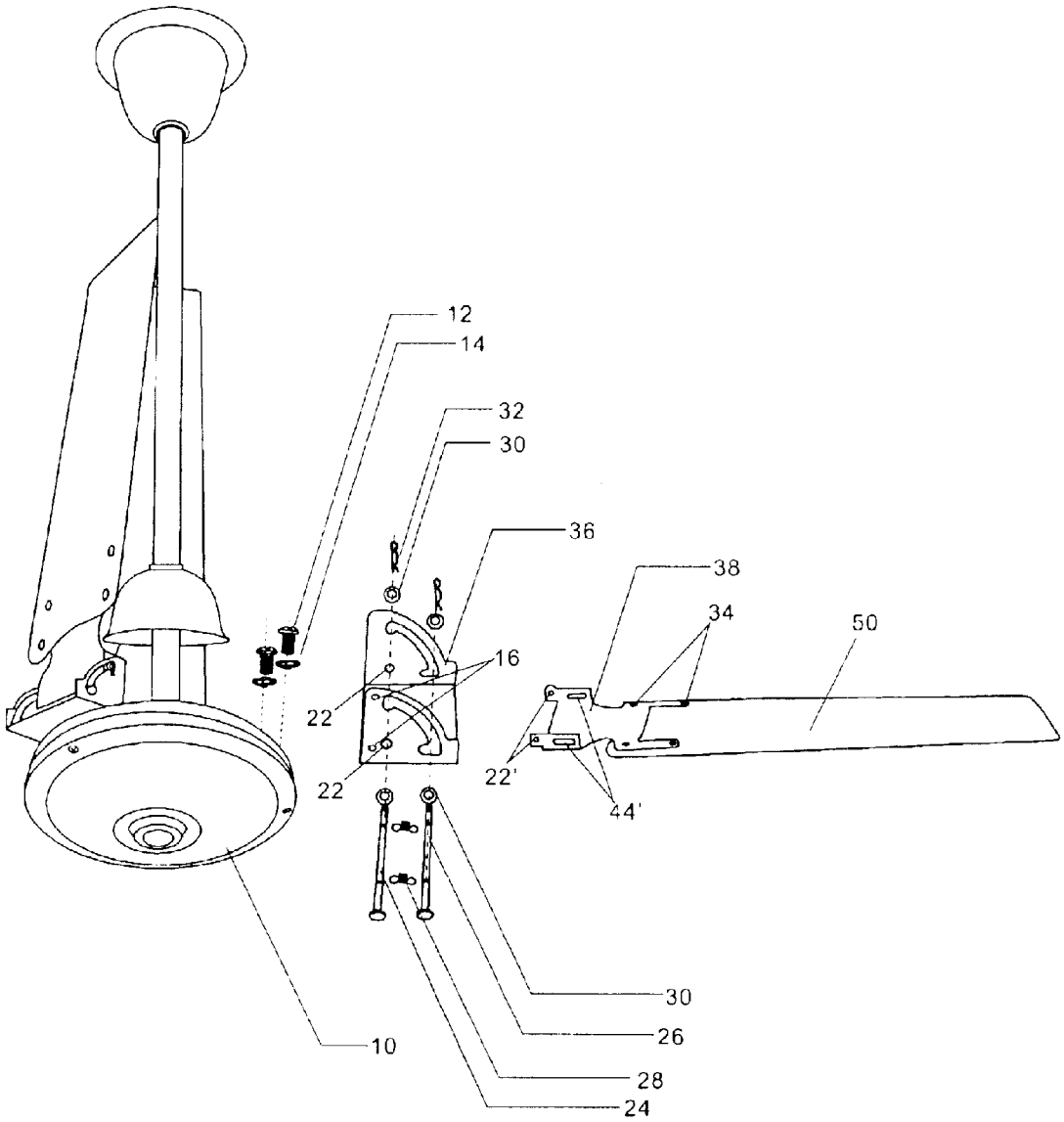
FIG. 2 is a plan perspective view of the parts and components of a preferred embodiment of the blade spreading assembly.
Figure 3:
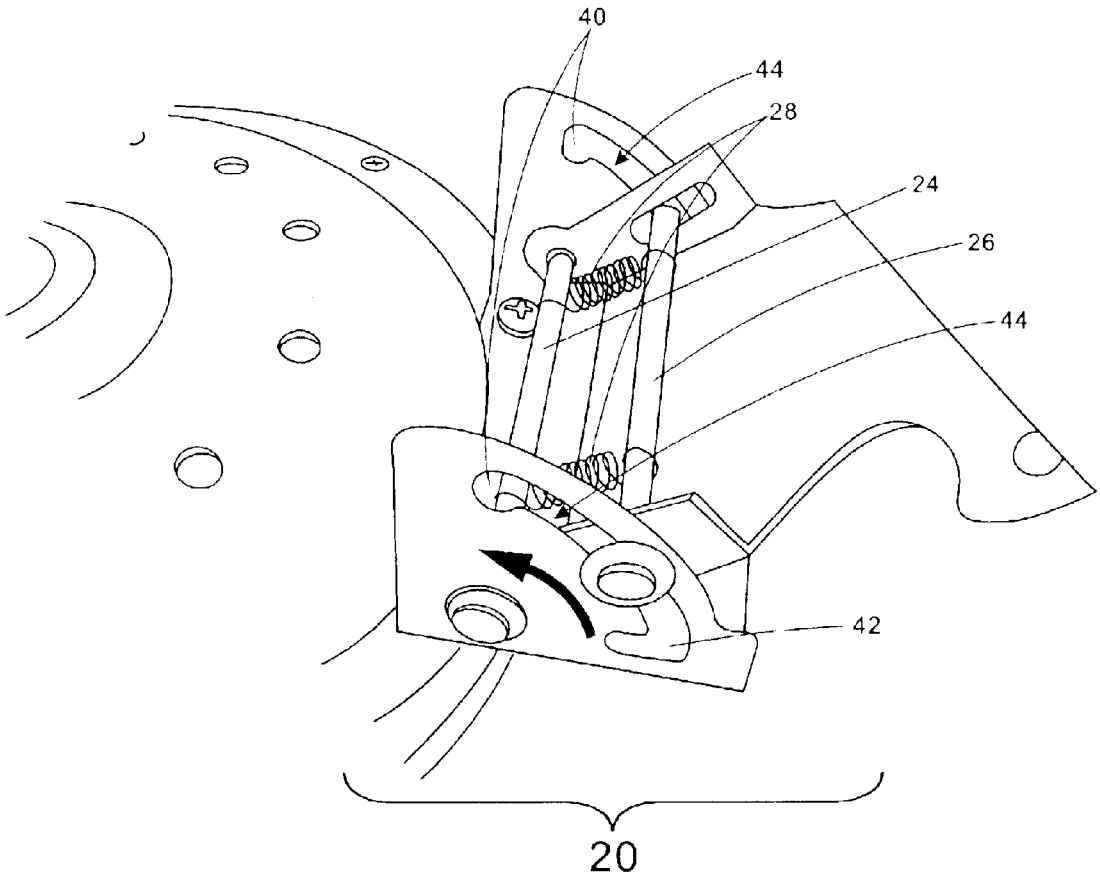
FIG. 3 is an enlarged scale, perspective view of a preferred embodiment of the blade spreading assembly with the parts and components engaged thereto.

Now referring to FIGS. 2 and 3, a preferred embodiment of the blade spreading assembly 20 according to the present invention is shown. The blade spreading assembly 20 is comprised of four groups of components, namely (1) a fan rotor bracket 36 made of a U-shaped metal; (2) a blade connecting arm 38 made of a substantially flat metal at the blade connecting end and a shorter U-shaped metal at the rotor bracket engaging end; (3) a pivoting pin 24 and a quick-release locking pin 26; and (4) a set of coil spring 28. In anther embodiment, it is unnecessary to have coil spring 28 (see FIGS. 8(*a*) and 8(*b*)).

Fan Rotor Bracket

Fan rotor bracket 36 has a U-shaped configuration. While the bracket 36 shown in the preferred embodiment is made of metal, it can suitably be made from other bard and strong materials, such as mould injection plastic. The U-shaped bracket 36 has two upward side walls, each takes the shape of a triangle and provide for an arc-shaped slot 44 along the outer edge of the hypotenuse of the triangle. Located at the top of arc slot 44 is a vertical recess notch 40 for receiving quick-release locking pin 26 when the blade arm 38 connecting to a fan blade is in a vertically collapsed position. Located at the bottom of arc slot 44 is a horizontal locking notch 42 for securing the quick-release pin 26 when the blade arm 38 connecting to a fan blade is in a horizontally operating spread out position.

Located near the comers of each of the triangular side walls of the fan rotor bracket 36 are two pivoting pin apertures 22.

A plurality of bracket lock apertures 16 for fastening the fan rotor bracket 36 to the upper side of the fan rotor 10 are provided on the horizontal surface of the U-shaped fan rotor bracket 36 and parallel to the fan rotor 10. Preferably, two bracket lock apertures 16 spaced apart are provided to receive bracket lock screws 12 and bracket lock spring washers 14. Other suitable conventional fastening means such as welding can be used to fasten bracket 36 to fan rotor 10.

Blade Connecting Arm

Blade connecting arm 38 is made of a substantially flat metal plate. Other hard and strong materials, such as mould injection plastic can be used for arm 38. It consists of a flat blade connecting end and a smaller U-shaped plate at the rotor bracket engaging end. The are a plurality of blade connecting arm apertures 34 provided near the blade connecting end of arm 38. Fan blade 50 can be connected to arm 38 by conventional fastening means, e.g., screws through apertures 34.

At the rotor bracket engaging end, there are two sets of apertures provided on each side of the upward surfaces of the U-shaped plate. Pivoting pin apertures 22' are positioned near the far end to correspond with similar pivoting pin apertures 22 on the blade rotor bracket 36. At the near side proximate to the blade connecting end, an elongated quick-release locking pin aperture 44' is provided on each side of the upward surface of the U-shaped plate. The distance between apertures 22' and 44' approximates the distance between aperture 22 and arc slot 44. This design arrangement will become apparent later when the operation of pivoting pin 24 and quick-release locking pin 26 is discussed.

The width of the smaller U-shaped plate portion of the blade connecting arm 38 at the rotor bracket engaging end should be fittingly smaller than the triangular side walls of the larger U-shaped plate portion of the fan rotor bracket 36. This allows the rotor bracket engaging end of the blade connecting arm 38 to operatively abut inside fan rotor bracket 36.

Pivoting Pin and Quick-Release Locking Pin

Fan rotor bracket 36 and blade connecting arm 38 are operatively engaged by the action of two pins, namely a pivoting pin 24 and a quick-release locking pin 26.

Referring to FIG. 2, pivoting pin 24 goes through first metal washer 30 into pivoting pin aperture 22 of bracket 36, then through the two pivoting pin apertures 22' of connecting arm 38, and exists through the other pivoting pin aperture 22 on the far end of bracket 36, and finally secured by a second metal washer 30 and split pin 32.

Similarly, quick-release locking pin 26 goes through first metal washer 30 into horizontal locking notch 42 of bracket 36, then through the two quick-release locking apertures 44' of connecting arm 38, and exists through the other horizontal locking notch 42 on the far end of bracket 36, and then secured by a second metal washer 30 and split pin 32.

Coil Spring Set

Figure 4:
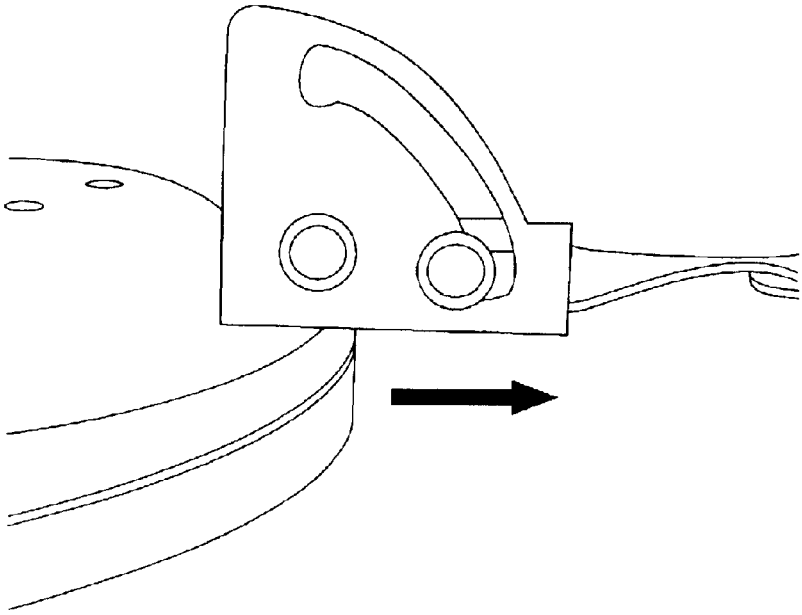
FIG. 4(*a*) is a plan side view of a preferred embodiment of the blade spreading assembly attached to the right hand side of the fan rotor and shows part of one fan blade in a horizontally spread out position.
Figure 4:
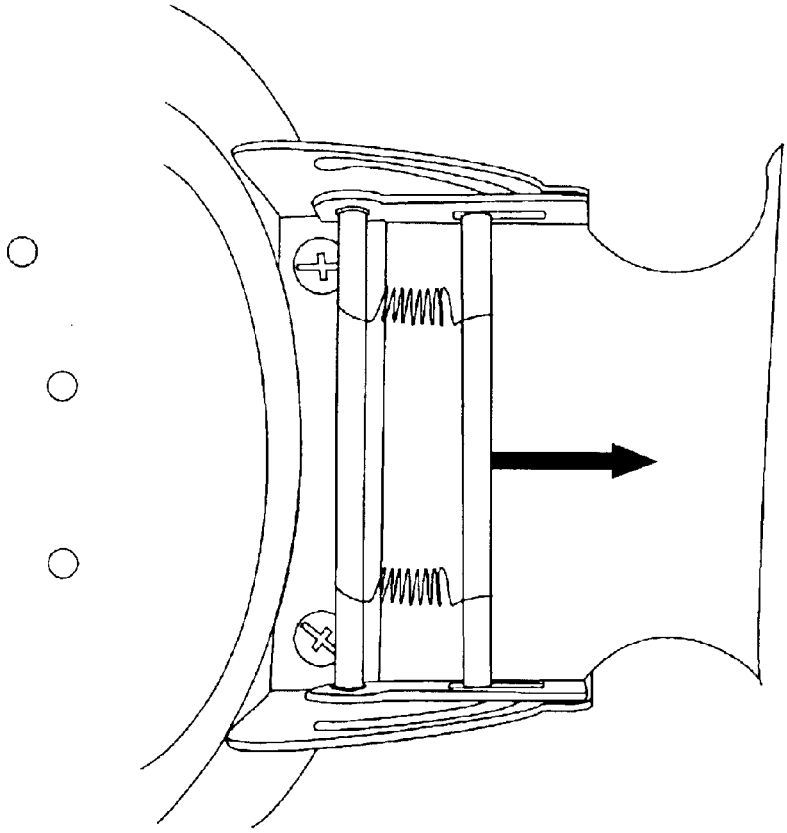

In the preferred embodiment, a set of coil spring, for example, two coil springs 28 are provided to urge pivoting pin 24 and quick-release locking pin 26 together. As illustrated in FIG. 3 and FIGS. 4(*a*) and 4(*b*), when the fan blade is spread out in the horizontal operating position, the biasing force of springs 28 pulls the quick-release locking pin 26 towards the recess in the horizontal locking notch 42, thus locking and securing the spread fan blade in position.

Figure 5:
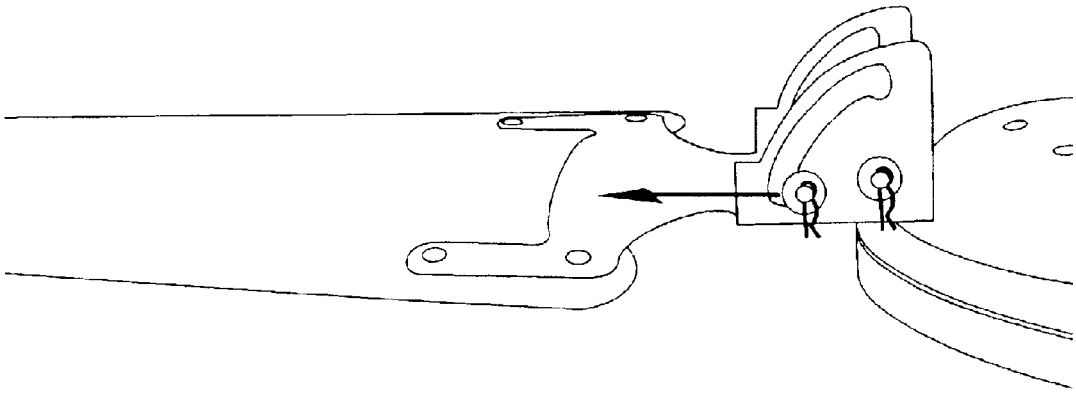
FIG. 5(*a*) is a plan side view of a preferred embodiment of the blade spreading assembly attached to the left hand side of the fan rotor and shows part of one fan blade in a horizontally spread out position.
Figure 5:
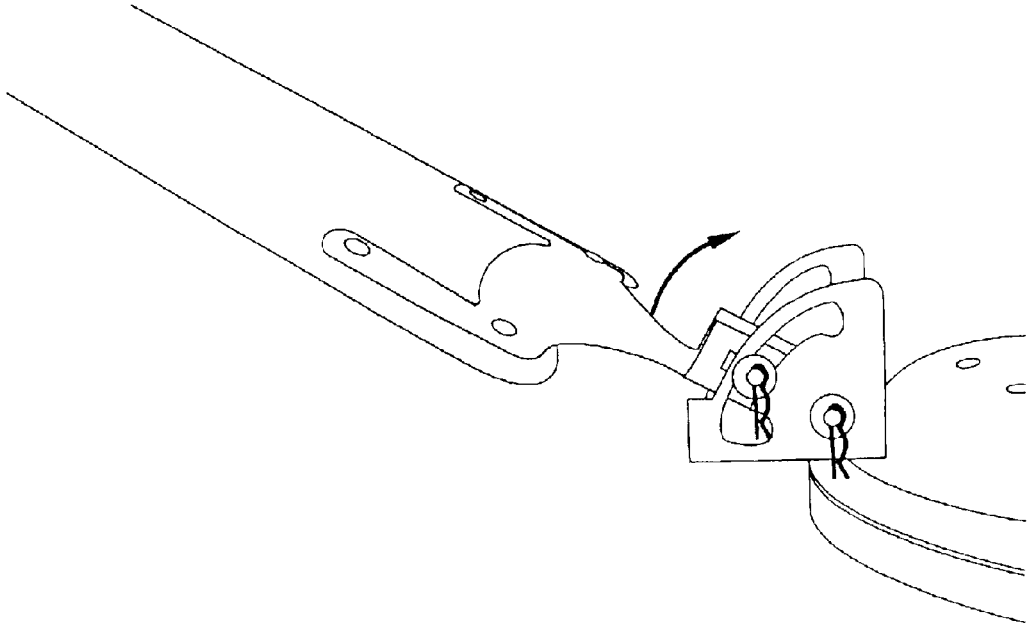
Figure 6:
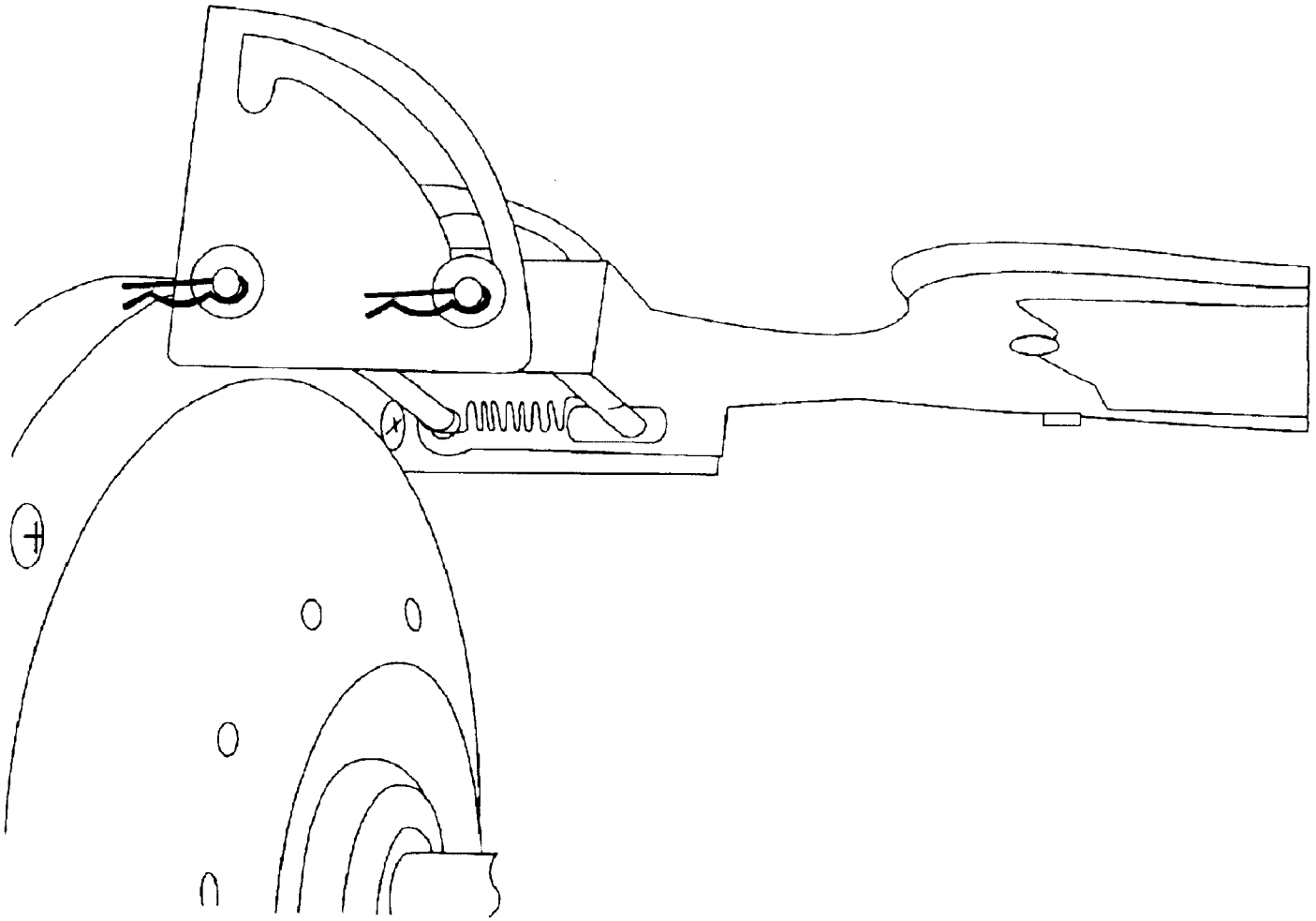
FIG. 6 is a plan side view of a preferred embodiment of the blade spreading assembly attached to the left hand side of the fan rotor and shows part of one fan blade in a vertically collapsed position.

If the user wishes to collapse the fan blade, all the user needs to do is to pull the quick-release locking pin 26 away from the recess of notch 42, as shown in FIGS. 4(*a*), 4(*b*) and FIG. 5(*a*), followed by an upward push motion (see FIG. 5(*b*)) as the quick-release locking pin 26 travels up arc slot 44. The fan blade will stop when the quick-release locking pin 26 reaches the top of arc slot 44 and rests in the recess defined by vertical recess notch 40 (see FIG. 6).

On the other hand, if the user wishes to spread out the fan blade, the user only needs to push the blade outward and downward. There is no need to pull the quick-release locking pin 26 as pin 26 is not locked in vertical recess notch 40, but merely residing firmly in the recess of vertical recess notch 40 by the biasing action of coil springs 28.

Figure 7:
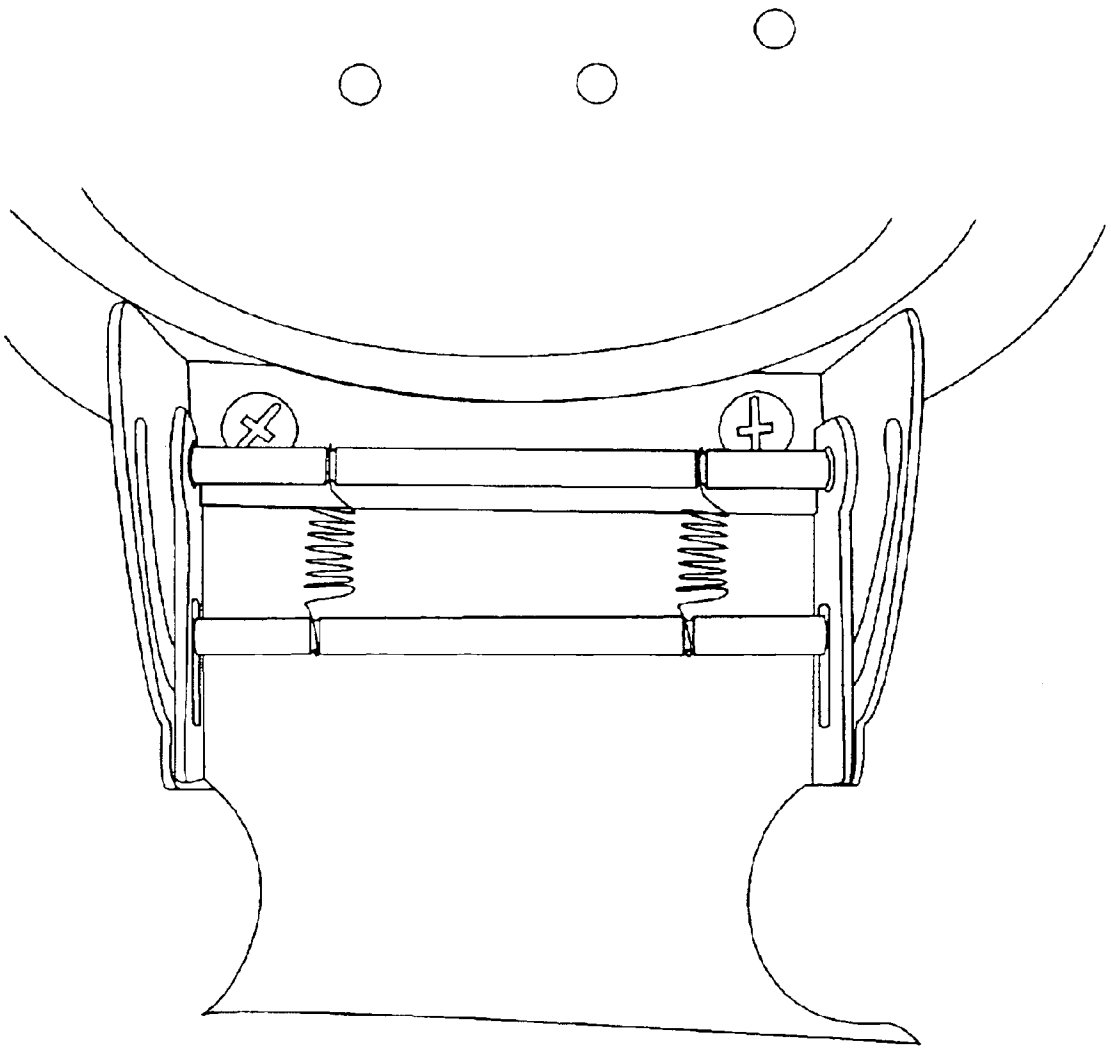
FIG. 7 is a plan top view of another embodiment of the blade spreading assembly attached to the right hand side of the fan rotor and shows part of one fan blade in a horizontally spread out position.

Optionally, grooves can be provided on the pivoting pin 24 and quick-release locking pin 26 so that coil springs 28 are securely positioned on these two pins (see FIG. 7).

Figure 8A:
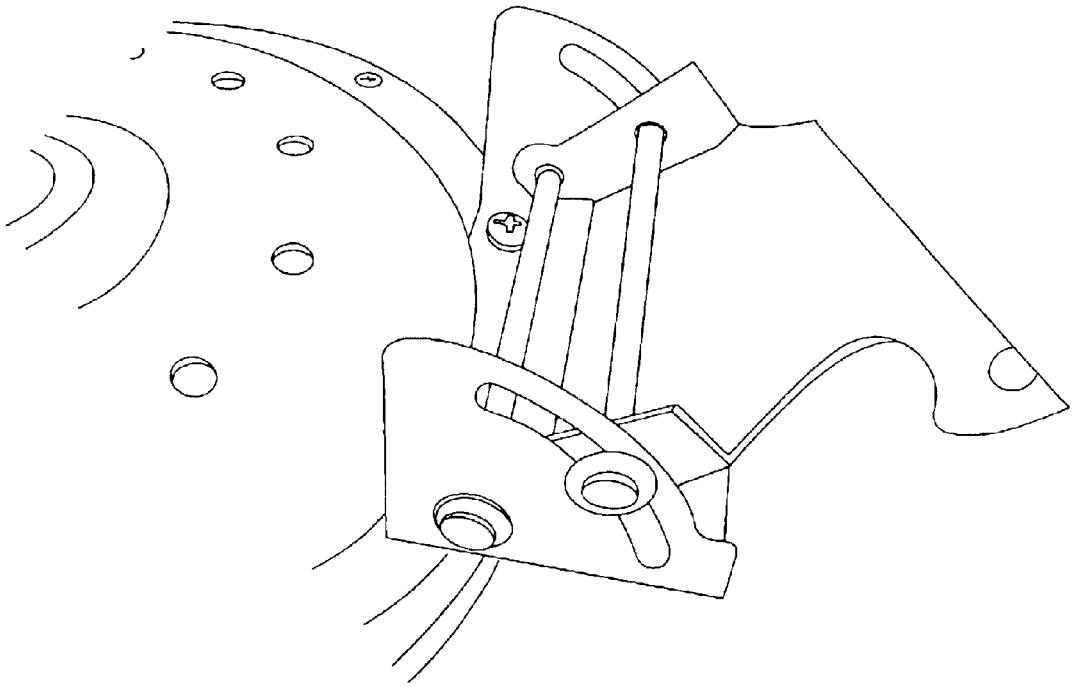
FIG. 8(*a*) is an enlarged scale, perspective view of another embodiment of the blade spreading assembly with the parts and components engaged thereto.
Figure 8B:
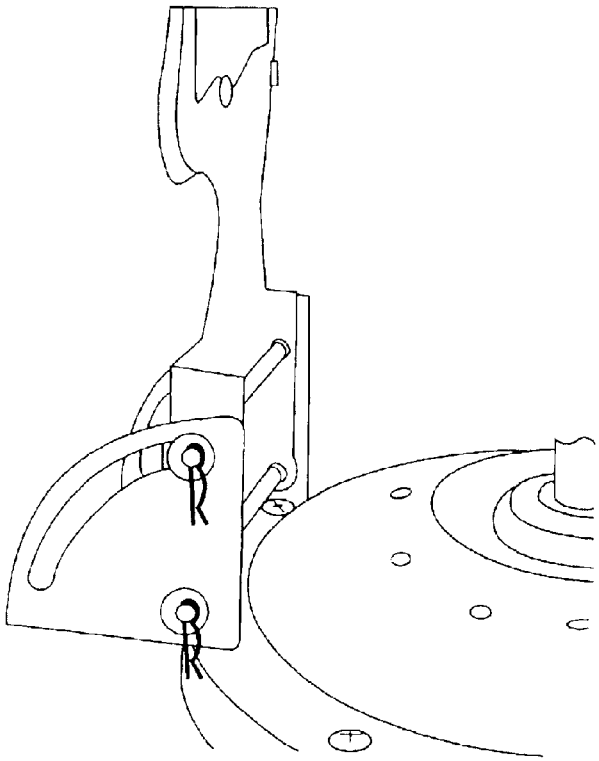

According to another embodiment of the present invention, there is no need to have any coil spring to urge pivoting pin 24 and quick-release locking pin 26. This is illustrated in FIGS. 8(*a*) and 8(*b*). Since there is no coil spring involved, there is no recess provided in the horizontal locking notch 42 and the vertical recess notch 40. Likewise, the quick-release locking pin apertures 44' on the blade connecting arm 38 are circular in shape and not elongated.

Hence, although the present invention has been described with referenced to a preferred embodiment, it will be appreciated by those skilled in the art that various modifications, alternations, variations, and substitutions of parts and components may be made without departing from the spirit and scope of the invention. Therefore, the present application is intended to cover such modifications, alternations, variations, and substitutions of parts and components.

What is claimed is:

1. A blade spreading assembly for quick ceiling fan installation, comprising a pivoting pin and a locking pin;

a U-shaped fan rotor bracket with two upward side walls, each side wall is provided with an aperture and an arc-shaped slot for coupling with the pivoting pin and for guiding the upward and downward movement of the locking pin, respectively; said arc slot is provided with a recess notch and a locking notch at the top and at the bottom, respectively, for securing the pivoting pin and the locking pin in position;

a blade connecting arm, said arm is substantially flat at one end for attaching to a fan blade and is U-shaped at the opposite end for operatively coupling with the pivoting pin and locking pin through an elongated aperture when said arm is engaged with said fan rotor bracket; and a set of coil spring for urging said pivoting pin and said locking pin towards each other.

2. The blade spreading assembly according to claim 1, wherein one or more grooves are provided on said pivoting pin and said locking pin for securing the coil spring in position.

3. The blade spreading assembly according to claim 1, wherein fastening means are provided on said fan rotor bracket for fastening said bracket on a fan rotor.

4. The blade spreading assembly according to claim 3, wherein said fastening means comprises one or more apertures on the horizontal surface of said fan rotor bracket for receiving a washer and a screw.

5. The blade spreading assembly according to claim 1, wherein the distance between said pin aperture on the blade connecting arm and the locking pin aperture is approximately the same as the distance between the pivoting pin aperture on the fan rotor bracket and the arc slot.

6. The blade spreading assembly according to claim 1, wherein the pivoting pin and the locking pin are secured to said assembly in position by a split pin.

7. The blade spreading assembly according to claim 1, wherein said fan rotor bracket and said blade connecting arm are made of metal.

8. The blade spreading assembly according to claim 1, wherein said fan rotor bracket and said blade connecting arm are made of mould injection plastic.

9. A ceiling fan comprising a plurality of blade spreading assembly of claim 1, with fan blade attached to said fan blade connecting arm with fastening means.

10. A blade spreading assembly for quick ceiling fan installation, comprising a pivoting pin and a locking pin;

a U-shaped fan rotor bracket with two upward side walls, each side wall is provided with an aperture and an arc-shaped slot for coupling with the pivoting pin and for guiding the upward and downward movement of the locking pin, respectively; and a blade connecting arm, said arm is substantially flat at one end for attaching to a fan blade and is U-shaped at the opposite end for operatively coupling with the pivoting pin and locking pin when said arm is engaged with said fan rotor bracket.

11. The blade spreading assembly according to claim 10, wherein the pivoting pin and the locking pin are secured to said assembly in position by a split pin.

* * * * *